US005368787A

United States Patent [19]

Yonamoto et al.

[11] Patent Number: 5,368,787

[45] Date of Patent: Nov. 29, 1994

[54] WHITE SMOKE GENERATING APPARATUS

[75] Inventors: Koh Yonamoto; Hiroyuki Sawada; Tetsuya Kanno, all of Kawasaki, Japan

[73] Assignee: Nippon Sanso Corporation, Tokyo, Japan

[21] Appl. No.: 88,184

[22] Filed: Jul. 6, 1993

[30] Foreign Application Priority Data

Jun. 4, 1993 [JP] Japan ..... 5-030081[U]

[51] Int. Cl.[5] ..... B01F 3/04

[52] U.S. Cl. ..... 261/36.1; 261/117; 261/118; 239/545; 239/434

[58] Field of Search ..... 261/36.1, 117, 118; 239/545, 433, 434

[56] References Cited

U.S. PATENT DOCUMENTS

| | | | |
|---|---|---|---|
| 618,615 | 1/1899 | Prinz | 239/545 |
| 1,762,762 | 6/1930 | Coffey | 261/117 |
| 2,468,865 | 5/1949 | Campobasso et al. | 261/117 |
| 2,858,903 | 11/1958 | Goetz et al. | 261/117 |
| 3,151,064 | 9/1964 | Lathrop | 261/117 |
| 3,539,102 | 11/1970 | Lang | 239/545 |
| 3,835,796 | 9/1974 | Sanga | 261/117 |
| 3,934,641 | 1/1976 | Chielens | 239/433 |
| 4,483,805 | 11/1984 | Glindsjo | 261/117 |

*Primary Examiner*—Tim Miles
*Attorney, Agent, or Firm*—Thompson, Hine & Flory

[57] ABSTRACT

A white smoke generating apparatus comprising a vessel, a discharge opening for discharging white smoke generated in said vessel to the exterior of said vessel, a cryogenic gas spray opening for spraying cryogenic gas, and a water spray opening for spraying heated water. The cryogenic gas spray opening and water spray opening are provided inside the aforementioned vessel, and these cryogenic gas spray opening and water spray opening are arranged such that cryogenic gas, discharged from the cryogenic gas spray opening, and heated water, discharged from the water spray opening, counter or cross contact. As a result, according to the present invention, white smoke can be generated with a high efficiency using only a small amount of cryogenic gas.

20 Claims, 6 Drawing Sheets

WHITE SMOKE GENERATING APPARATUS

BACKGROUND OF THE INVENTION

1. Field of the Invention

The present invention relates to a white smoke generating apparatus which generates white smoke by means of placing water in contact with a cryogenic gas such as liquid nitrogen, liquid air or liquid carbon dioxide gas, and then vaporizing this gas.

2. Background Art

In the prior art, white smoke generating apparatuses for use in enhancing the stage effects of various shows and events, such as that shown in FIG. 7, are known.

This type of white smoke generating apparatus generates white smoke by blasting a cryogenic gas such as liquid nitrogen, liquid air or liquid carbon dioxide gas onto the surface of water, stored in a storage tank, and then vaporizing this gas: the water spray accompanying the aforementioned condenses thereby generating white smoke.

In the following, an example is described in which liquid nitrogen (hereafter referred to as $LN_2$) is employed as the cryogenic gas.

White smoke generating apparatus 1 shown in FIG. 7, generates white smoke 56 by spraying $LN_2$ onto the surface 60 of warm water 58, and then vaporizing this $LN_2$. This white smoke generating apparatus 1 mainly comprises a fixed or mobile water tank 2 for storing warm water 58; an $LN_2$ spray opening 3 comprising a spray structure such as a spray nozzle or the like for spraying $LN_2$ onto water surface 60 of water tank 2; a discharge opening 4, provided above water surface 60 of water tank 2, for discharging into the air white smoke 56, generated when $LN_2$ comes in contact with warm water; and a heater 5 for heating and maintaining the temperature of the warm water 58.

A side surface 2*a* of this water tank 2 is equipped with a liquid level indicator 6 and a water supply pipeline, while the bottom face 2*b* is equipped with a water pipeline 8 for use in drainage.

In addition, mist trap 9 is a filter installed in discharge opening 4 for removing the mist contained in the white smoke 56. $LN_2$ is stored inside a thermally insulated pressure vessel 10 for use in low temperature storage.

In order to generate white smoke 56 using this white smoke generating apparatus 1, water is poured into water tank 2 up to a predetermined depth, and this water is then heated to a predetermined temperature (usually to approximately 30°–80° C.) using heater 5. The valve of thermally insulated pressure vessel 10 is then opened, and $LN_2$ is supplied to $LN_2$ spray opening 3 and sprayed onto the surface 60 of the warm water 58, thereby coming into contact with the warm water. In this manner, white smoke 56 is generated, and after the mist in the white smoke 56 is removed by mist trap 9, this generated white smoke 56 is discharged into the air via discharge opening 4.

Stoppage of the generation of white smoke 56 is performed by closing the valve of thermally insulated pressure vessel 10 which interrupts the supply of $LN_2$ to $LN_2$ spray opening 3.

However, prior art white smoke generating apparatus 1 is disadvantageous in that the usage amount of the cryogenic gas (e.g. $LN_2$) is approximately the same as the yield of white smoke 56, thus the running cost of the $LN_2$ is significantly large. In particular, in the case when it is necessary to generate a large amount of white smoke 56 to enhance the stage effects of various shows and events, a considerably large amount of $LN_2$ must be consumed, resulting in significant cost increases.

In addition, other disadvantages exist in that when continuously generating the white smoke 56 over long periods of time, although the warm water 58 is heated to maintain its temperature, due to the extremely low temperature of the $LN_2$ (approximately 77° K.), the water surface 60 freezes which in turn reduces the vaporization efficiency of $LN_2$, consequently lowering the yield of the white smoke.

The present invention takes into consideration the aforementioned, and provides a white smoke generating apparatus which is able to prevent freezing of the water surface and also to prevent subsequent reduction of the white smoke yield, and which also effectively reduces the usage amount of the cryogenic gas.

SUMMARY OF THE INVENTION

The white smoke generating apparatus according to the present invention comprises a water tank for storing water, a cryogenic gas spray opening for spraying the cryogenic gas above the water surface of the water tank, a discharge opening, provided above the water surface of the aforementioned water tank, for discharging to the exterior of the water tank white smoke generated inside this water tank, a temperature adjuster for heating and maintaining the temperature of the water inside the water tank, a circulating water sprinkler for spraying water inside the water tank from a water spray opening located near the cryogenic gas spray opening, wherein the white smoke generating apparatus is constructed in a manner such that the water and cryogenic gas discharged from the water spray opening and cryogenic gas spray opening, respectively, cross contact. In the present invention, the term "cross contact" includes counter contact (180°) and contact at right-angles (90°) as well. In addition, in a vessel, in which the discharge opening for discharging to the exterior the white smoke generated in the interior of the vessel is provided, the white smoke generating apparatus of the present invention is equipped with a cryogenic gas spray opening for spraying the cryogenic gas which is introduced, and a water spray opening for spraying heated water, in a manner such that this water counter or cross contacts the cryogenic gas sprayed from the cryogenic gas opening.

In accordance with the aforementioned construction of the present invention, the sprays of the water and cryogenic gas counter or cross contact, thereby causing sufficient mixing of these components. As a result, according to the present invention, white smoke can be generated with a high efficiency using only a small amount of cryogenic gas.

In particular, in this type of white smoke generating apparatus, by providing a plurality of both cryogenic gas spray openings and water spray openings, the cryogenic gas/water contact can be further increased, thereby improving the white smoke yield efficiency.

In addition, in the aforementioned white smoke generating apparatus, a white smoke temperature regulator is provided for spraying water inside this water tank between the aforementioned cryogenic gas spray opening and discharge opening.

Before the white smoke generated through the use of this white smoke temperature regulator is discharged to the exterior from the discharge opening, the temperature of this white smoke is regulated, and thus various states of white smoke, for example rising smoke or falling smoke, can be easily formed.

Furthermore, the cryogenic gas spray opening and water spray opening are arranged in a manner such that the cryogenic gas and water discharged from each respective spray opening counter or cross contact with each other: they may be arranged facing each other in the vertical direction, horizontal direction (i.e. parallel to the water surface), or at angles (e.g. at right-angles to each other) such that their respective sprays counter or cross contact.

In addition, inside the warm water tank comprising a temperature adjuster, cryogenic gas maintained at an extremely low temperature and warm water are brought into contact by spraying, which in turn heats the surrounding region and creates an environment within the water tank which is inhospitable to ice. As a result, the thermal contact efficiency is drastically improved, and the appropriate or desired white smoke generation is continuously conducted.

As well, the water tank, the temperature adjuster for heating water stored inside this water tank, as well as, the circulating water sprinkler can be eliminated in the case of introducing preheated water inside the vessel in which the discharge opening is provided. Consequently, simplification of the structure of the apparatus is thus possible.

DETAILED DESCRIPTION OF THE EMBODIMENTS

[First embodiment]

Figure 1:
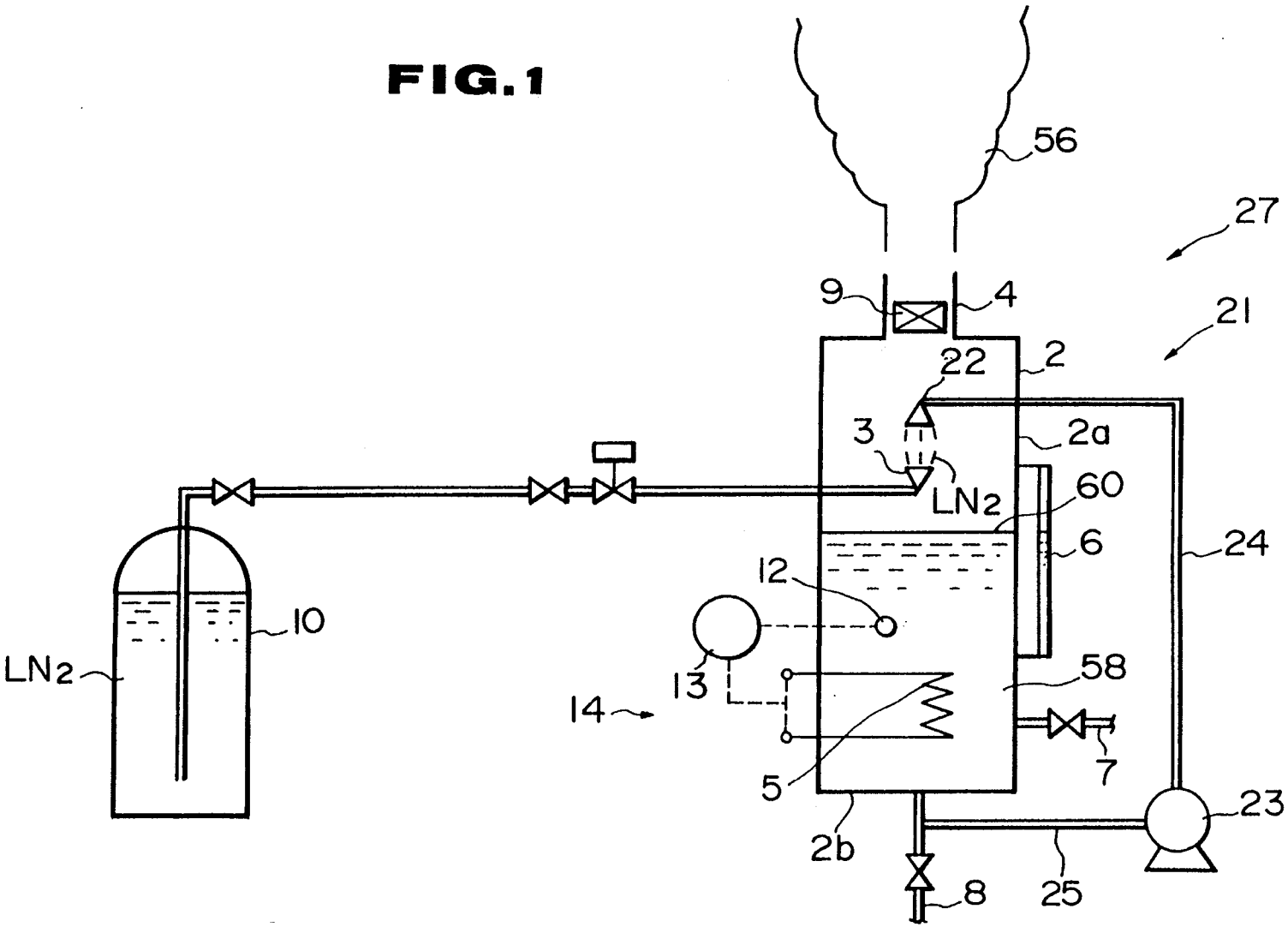
FIG. 1 shows a structural outline of a white smoke generating apparatus according to a first embodiment of the present invention.
Figure 2:
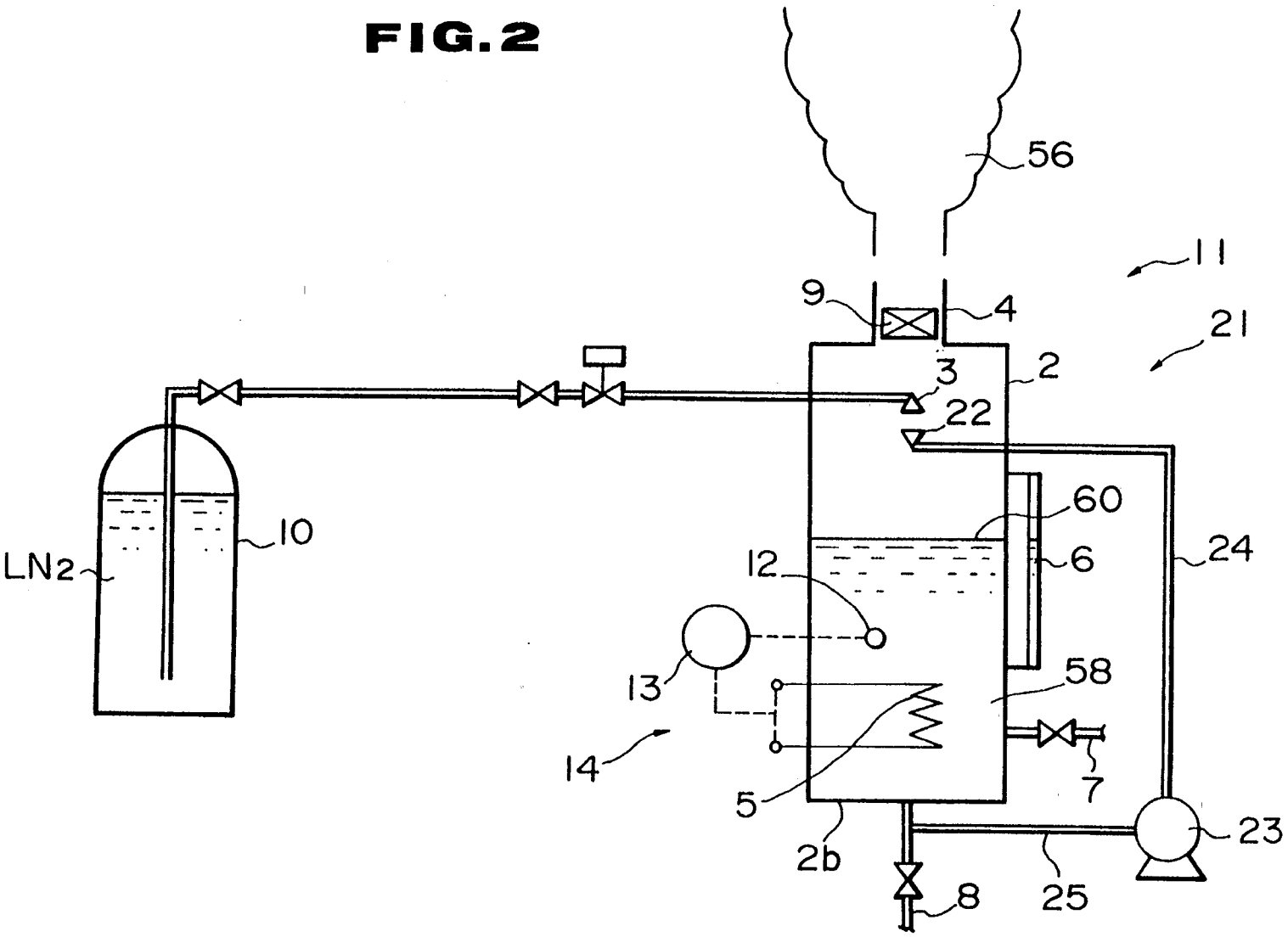
FIG. 2 shows a structural outline of a white smoke generating apparatus according to a second embodiment of the present invention.
Figure 7:
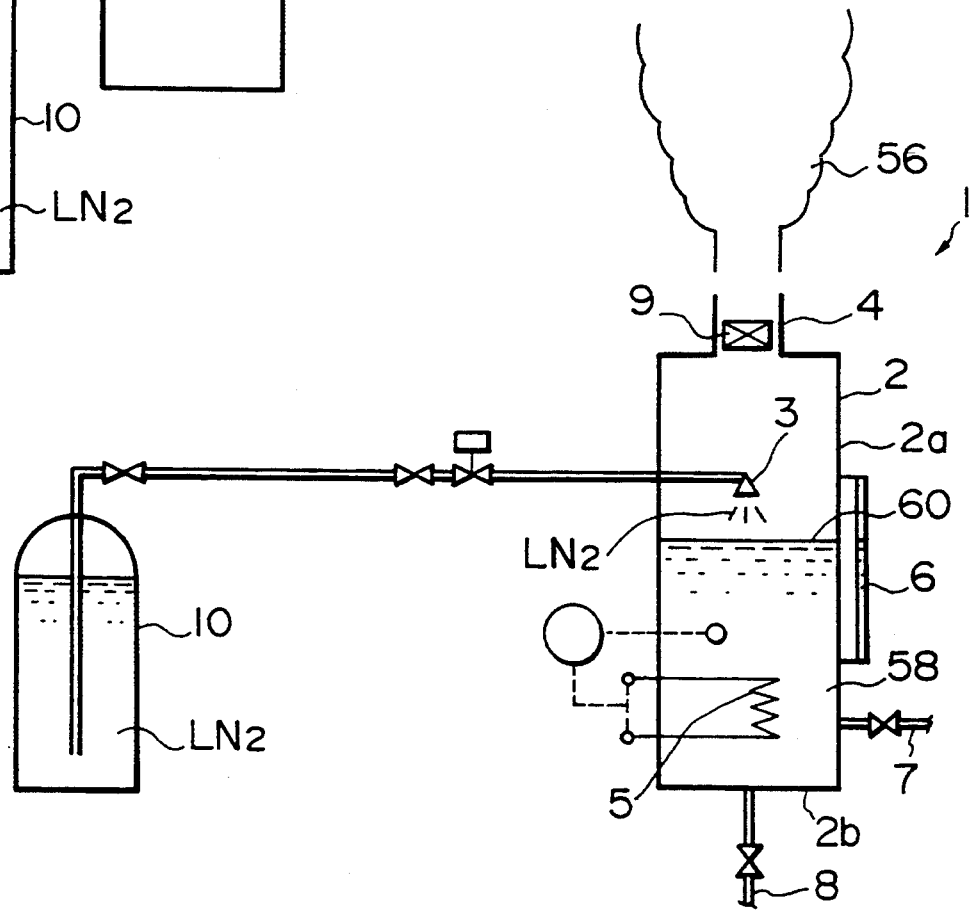
FIG. 7 shows a structural outline of a prior art white smoke generating apparatus.

FIG. 1 shows a structural outline of a white smoke generating apparatus according to a first embodiment of the present invention. In this FIG., structural components similar to those shown in FIG. 7 are designated by the same numerals and their explanations will be omitted.

The white smoke generating apparatus 27 of the present embodiment comprises a circulating water sprinkler 21 connecting to water tank 2 which drains water from the bottom portion of the aforementioned water tank 2, and sprays this water onto the water surface of this same water tank.

This circulating water sprinkler 21, mainly comprises water spray opening 22, circulating pump 23 and pipelines 24 and 25, and functions by removing warm water 58 to the exterior of water tank 2 and then spraying and circulating this water via water spray opening 22.

Additionally, by opening a valve, the $LN_2$ inside of thermally insulated pressure vessel 10 is released and sprayed out via $LN_2$ spray opening 3. The aforementioned water spray opening 22 and $LN_2$ spray opening 3 are arranged, for example facing each other, in a manner such that the warm water and $LN_2$ discharged from each respective opening counter contact. In this white smoke generating apparatus 27 shown in FIG. 1, cryogenic gas spray opening 3 is provided as the lower component relative to water spray opening 22, which is provided as the upper component. In this manner, the cryogenic gas discharged upwards from cryogenic gas spray opening 3, and the warm water discharged downwards from water spray opening 22, counter contact.

In water tank 2, a temperature adjuster 14 comprising a heater 5 for heating the water 58, a water temperature gauge 12 for measuring the water temperature, and a water temperature regulator 13 for regulating heater 5 based on the water temperature data obtained from water temperature gauge 12, is provided.

As temperature adjuster 14, it is possible to use other devices or constructions which are able to heat water, for example, a boiler or heat-transfer pipe.

In order to generate white smoke using white smoke generating apparatus 27, water is poured into water tank 2 up to a predetermined depth, and is heated to a predetermined temperature (usually 30 ° to 80° C.) using heater 5. The warm water 58 is then circulated by water sprinkler 21, and the valve of thermally insulated pressure vessel 10 is opened, supplying $LN_2$ to $LN_2$ spray opening 3. $LN_2$ is then vaporized by means of counter contacting the warm water and $LN_2$ discharged from spray openings 3 and 22 respectively. The vaporized nitrogen gas mixes with water at a high efficiency, forming white smoke 56 which is passed through mist trap 9 to remove the mist inside, and then discharged into the air via discharge opening 4.

In addition, stoppage of the generation of white smoke 56 is performed by closing the valve of thermally insulated pressure vessel 10 which thus stops the supply of $LN_2$ to $LN_2$ spray opening 3.

Consequently, by counter contacting the sprays of water and $LN_2$, the aforementioned apparatus is able to generate white smoke with a high efficiency using a comparatively small amount of $LN_2$.

Furthermore, inside the warm water tank comprising a temperature adjuster, cryogenic gas maintained at an extremely low temperature and warm water are counter contacted by spraying, which in turn heats the surrounding region and creates an environment within the water tank which is inhospitable to ice. As a result, the thermal contact efficiency is drastically improved, and the appropriate or desired white smoke generation is continuously conducted.

[Second embodiment]

In the white smoke generating apparatus 27 according to the first embodiment of the present invention, cryogenic gas spray opening 3 is provided as the lower component relative to water spray opening 22, which is provided as the upper component. In this manner, as shown in FIG. 1, the cryogenic gas discharged upwards from cryogenic gas spray opening 3, and the warm water discharged downwards from water spray opening 22, counter contact. However, in the white smoke generating apparatus 11 according to the second embodiment, cryogenic gas spray opening 3 is provided as the upper component relative to water spray opening 22, which is provided as the lower component. In this manner, the cryogenic gas discharged downwards from cryogenic gas spray opening 3, and the warm water discharged upwards from water spray opening 22, counter contact.

Consequently, similar to the white smoke generating apparatus 27 according to the first embodiment, the white smoke generating apparatus 11 according to the second embodiment is able to generate white smoke with a high efficiency using a comparatively small amount of $LN_2$.

[Third embodiment]

Figure 3:
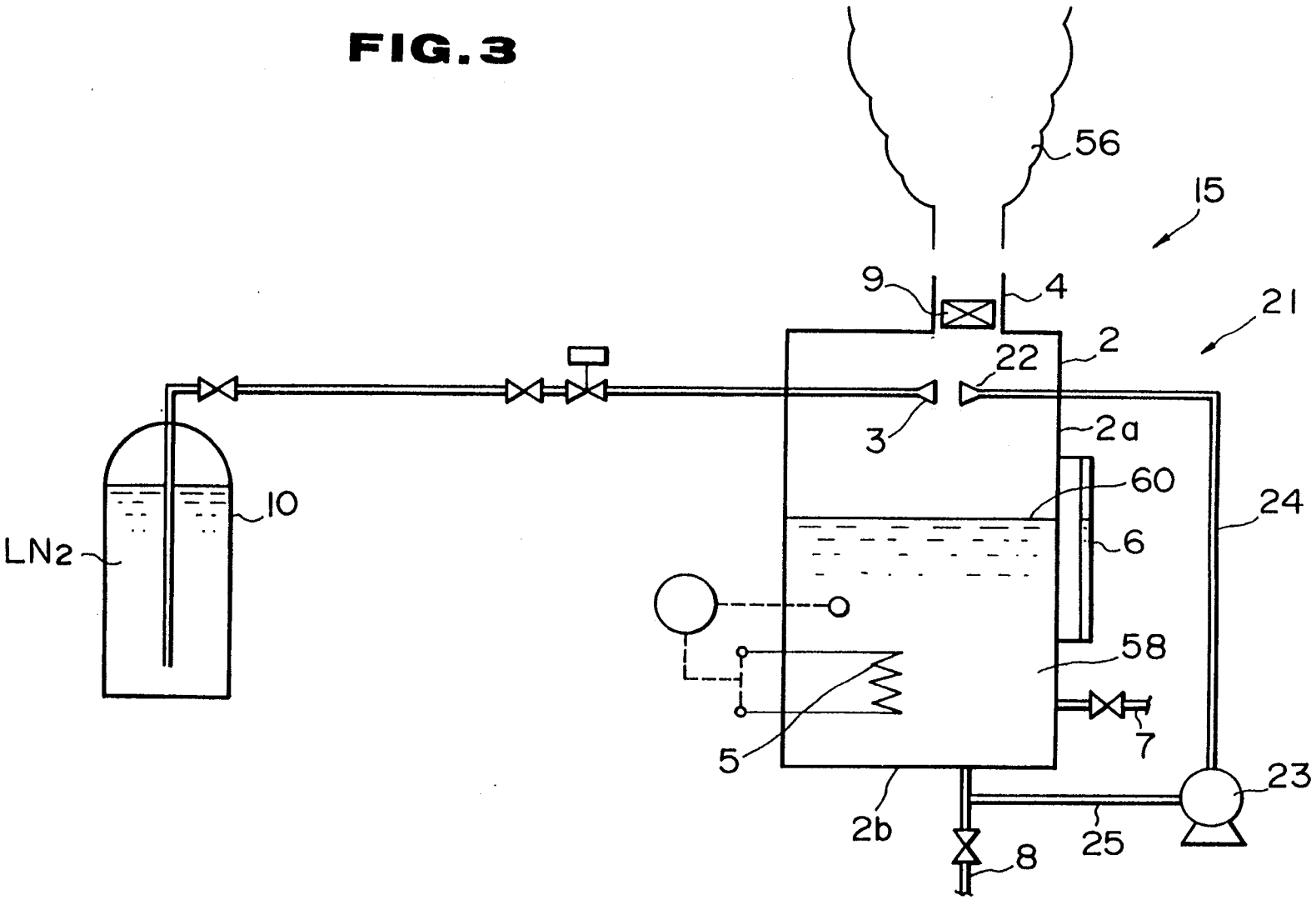
FIG. 3 shows a structural outline of a white smoke generating apparatus according to a third embodiment of the present invention.

In contrast to the vertically opposing orientations of cryogenic gas spray opening 3 and water spray opening 22 in the white smoke generating apparatuses 27 and 11 according to the first and second embodiments, in the white smoke generating apparatus 15 according to the third embodiment shown in FIG. 3, cryogenic gas spray opening 3 and water spray opening 22 are provided facing each other in the horizontal direction (parallel to the water surface).

Consequently, similar to the white smoke generating apparatuses according to the first and second embodiments, the white smoke generating apparatus 15 according to the third embodiment is able to generate white smoke with a high efficiency using a comparatively small amount of $LN_2$.

[Fourth embodiment]

Figure 4:
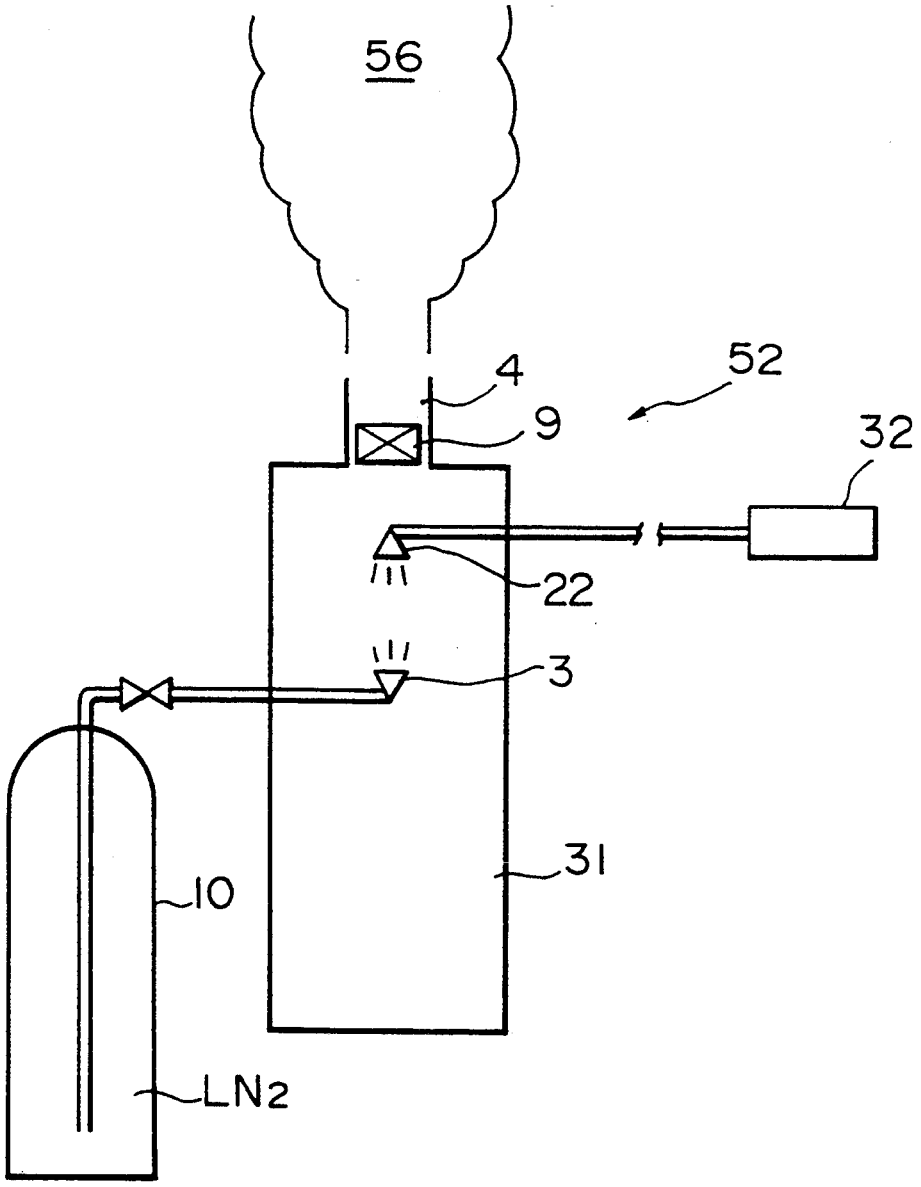
FIG. 4 shows a structural outline of a white smoke generating apparatus according to a fourth embodiment of the present invention.

The white smoke generating apparatus 52 according to the fourth embodiment shown in FIG. 4, employs a vessel 31, in which discharge opening 4 is provided, instead of the water tank of the aforementioned embodiments 1 to 3. In this apparatus, warm water that has been heated in a boiler 32, provided separately, is introduced and sprayed out from water spray opening 22; $LN_2$ is supplied to $LN_2$ spray opening 3, arranged facing the aforementioned water spray opening 22, from thermally insulated pressure vessel 10, which results in counter contact of the cryogenic gas and warm water discharged from these respective spray openings 3 and 22.

In this case, not only is white smoke generated with a high efficiency, but also devices such as the temperature adjuster for heating water stored inside this water tank, as well as, the circulating water sprinkler are unnecessary thus simplifying the apparatus.

In addition, when an arrangement is achieved in which a plurality of each of the aforementioned warm water spray opening 22 and $LN_2$ spray opening 3 are provided in a manner such that the cryogenic gas and warm water, discharged from respective spray openings 3 and 22, counter contact in all directions, the contact efficiency and white smoke generation efficiency can be even further improved.

[Fifth embodiment]

In the following, the white smoke generating apparatus according to the fifth embodiment will be explained with reference to FIG. 5.

Figure 5:
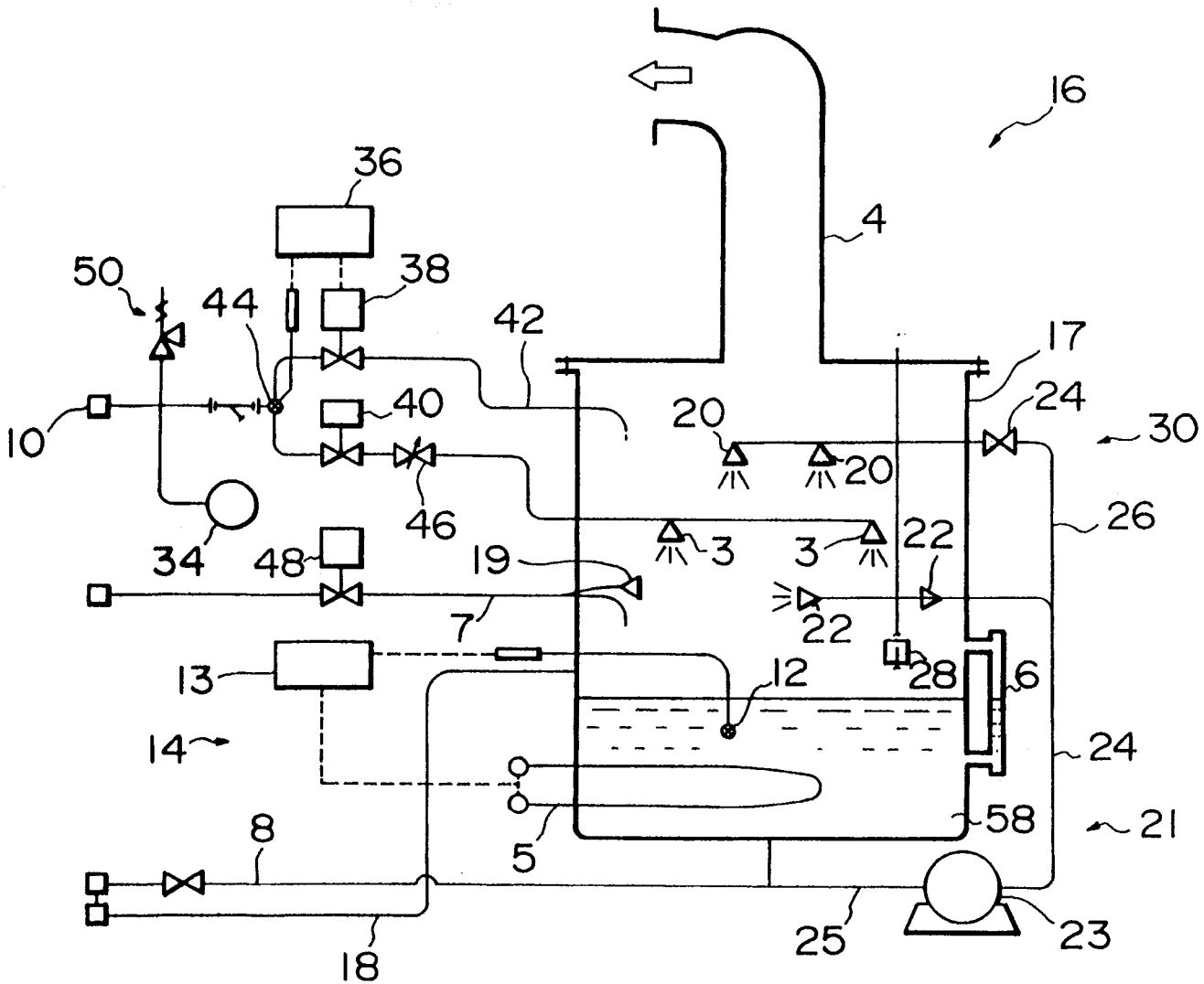
FIG. 5 shows a structural outline of a white smoke generating apparatus according to a fifth embodiment of the present invention.

The white smoke generating apparatus 16 shown in FIG. 5 mainly comprises a water tank 17, cryogenic gas spray openings 3 for spraying cryogenic gas into the aforementioned water tank 17, a discharge opening 4 located above the water surface of the water tank for discharging to the exterior the smoke generated inside water tank 17, temperature adjuster 14 for heating the water inside water tank 17, and a circulating water sprinkler 21 for spraying water inside water tank 17 via water spray openings 22 in a manner such that this water cross contacts with the cryogenic gas discharged from cryogenic gas spray openings 3.

Furthermore, in the white smoke generating apparatus 16 of the present embodiment, a white smoke temperature regulator 30 is also provided. The white smoke temperature regulator 30 shown in this embodiment mainly comprises nozzles 20 provided in pipeline 26 between cryogenic gas spray openings 3 and discharge opening 4, a circulating pump 23 for sending the water 58 inside water tank 17 to nozzle 20 via pipeline 26, a valve 24 provided in pipeline 26, a temperature sensor 28 for measuring the temperature inside water tank 17, and a temperature regulator (not shown in FIG. 5) for regulating circulating pump 23 and valve 24 based on the temperature data from temperature sensor 28.

In particular, in the present embodiment, circulating pump 23 and pipeline 25 drive both circulating water sprinkler 21 and white smoke temperature regulator 30 (i.e. supply water to both) thus yielding a high usage efficiency. However, these components may also be provided separately in an independent manner.

In addition, in white smoke generating apparatus 16 of the present embodiment, a pre-cooling pipeline 42 is provided which branches off from a pipeline connecting thermally insulated pressure vessel 10 and cryogenic gas spray opening 3. The end of this pre-cooling pipeline 42 is positioned inside of water tank 17. Furthermore, a regulated solenoid valve 38 is provided in this pre-cooling pipeline 42, which is regulated by means of cryogenic gas controller 36 connecting to cryogenic gas sensor 44 provided at the branching point of pre-cooling pipeline 42.

Additionally, numeral 48 is a water supply solenoid valve provided in water supply pipeline 7, numeral 18 represents an overflow pipeline for allowing overflow, numeral 34 is a cryogenic gas pressure gauge, and numeral 50 is a safety valve.

In order to generate white smoke using the white smoke generating apparatus 16 according to the fifth embodiment, water is supplied up to a predetermined depth to water tank 17 through water supply pipeline 7, and is heated to a predetermined temperature using heater 5. The warm water 58 is then circulated by water sprinkler 21, and white smoke generating solenoid valve 40 and white smoke yield control valve 46 are opened, supplying $LN_2$ to $LN_2$ spray opening 3.

In this white smoke generating apparatus 16 according to the fifth embodiment, instead of being arranged facing each other, cryogenic gas spray opening 3 and water spray opening 22 are arranged at right-angles to each other in a manner such that the cryogenic gas and water discharged from each respective opening cross contact. The nitrogen gas mixes with water at a high efficiency, forming white smoke 56 which is then discharged into the air via discharge opening 4.

In addition, water may also be sprayed out from nozzle 19 provided in water supply pipeline 7. In this case, a heating device such as a heater or boiler is preferably provided in the aforementioned water supply pipeline 7.

As well, in the present embodiment, a white smoke temperature regulator 30 is provided which regulates the temperature of the white smoke 56 generated by spraying warm water 58 into the upper portion of water tank 17 from nozzles 20. In other words, when white smoke 56 at a high temperature to be discharged from discharge opening 4 is preferred, water at a high temperature is sprayed from nozzle 20, while when white smoke 56 at a low temperature to be discharged from discharge opening 4 is preferred, water at a lower temperature is sprayed from nozzle 20.

In general, the properties of the white smoke vary according to temperature of the white smoke itself. For example, white smoke at a high temperature rises upward (rising smoke), while white smoke at a low temperature falls downward (failing smoke).

In the white smoke generating apparatus 16 according to the fifth embodiment, when water at a temperature of 30° C. is sprayed (33 L/min.) from nozzle 20, the white smoke 56 discharged from discharge opening 4 is heavier than atmospheric air, and thus after being discharged into the air, smoke of this nature descends and accumulates on the ground surface. In contrast, when water at a temperature of 50° C. is sprayed, the white smoke floats parallel to the water surface, and when water at a temperature of 80° C. is sprayed, the white smoke 56 rises (5 to 10 m).

Consequently, in the white smoke generating apparatus 16 according to the fifth embodiment, due to the existence of white smoke temperature regulator 30, the temperature of the white smoke can be regulated, and the properties of the white smoke discharged, can be controlled.

As a result, various types of white smoke can be generated to accommodate the usage conditions of floating white smoke, rising white smoke and the like, and thus the enhancement of performances of various shows and events can also be easily carried out.

Furthermore, when cryogenic gas is sprayed out from cryogenic gas spray opening 3, which functions as a nozzle, phenomena occur such as insufficient cooling of the pipeline connecting cryogenic gas spray opening 3 and thermally insulated pressure vessel 10, and difficulty at the immediate start of spraying the cryogenic gas, however, in the present embodiment, with the provision of pre-cooling pipeline 42, it is possible to shorten the start-up period of the white smoke generation.

In other words, at the start of smoke generation, the regulated solenoid valve 38 is opened, and cryogenic gas flows to water tank 17 via pre-cooling pipeline 42 which does not have spray nozzles resulting in a low flow resistance. Subsequently, the temperature at the point measured by the cryogenic gas sensor 44 is sufficiently low, and spraying from cryogenic gas spray opening 3 works without difficulty, regulated solenoid valve 38 is closed by cryogenic gas controller 36, following which all of the cryogenic gas is discharged via cryogenic gas opening 3. In this manner, it is possible to shorten the start-up period until the normal introduction of the cryogenic gas into the water tank 17. Actually, the period from the opening of the valve of thermally insulated pressure vessel 10 until the start of white smoke generation was shortened to one-tenth.

[Sixth embodiment]

Figure 6:
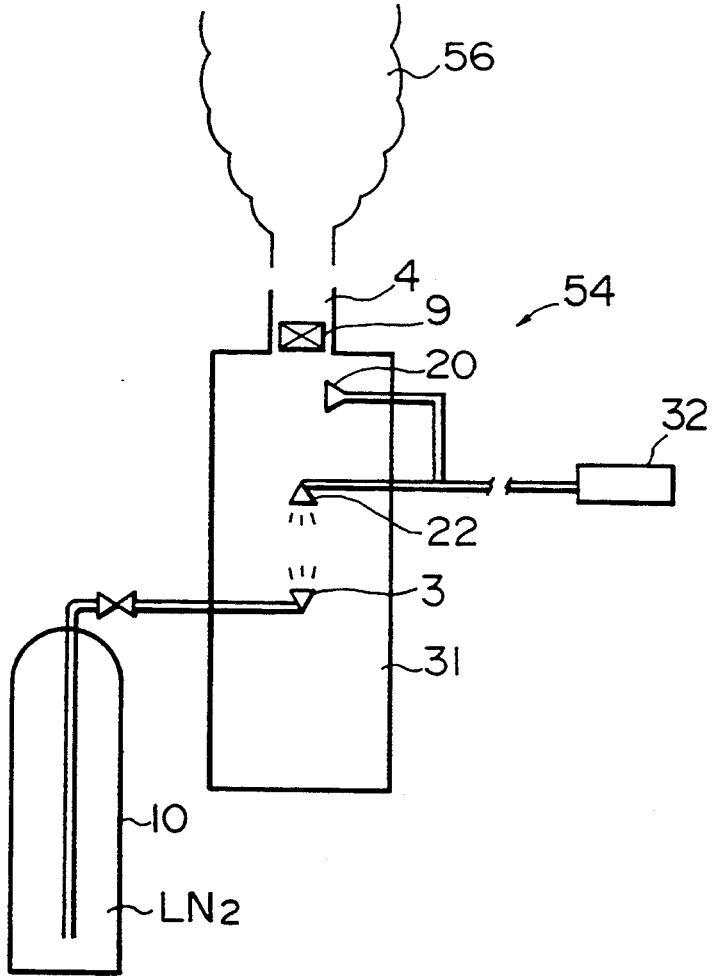
FIG. 6 shows a structural outline of a white smoke generating apparatus according to a sixth embodiment of the present invention.

The white smoke generating apparatus 54 according to the sixth embodiment shown in FIG. 6, adds a white smoke temperature regulator to the aforementioned white smoke generating apparatus 52 according to the fourth embodiment.

In white smoke generating apparatus 54, a white smoke temperature regulator, comprising nozzle 20 positioned above cryogenic gas spray opening 3 and water spray opening 22, and below discharge opening 4, is provided for spraying warm water from this aforementioned nozzle.

By means of spraying warm water (e.g. 30 ° to 80° C.) from nozzle 20, the temperature of the white smoke 56 generated inside vessel 31 can be regulated, which in turn allows for the manufacturing of various smoke such as rising smoke and falling smoke.

Furthermore, in the present embodiment, boiler 32 which supplies warm water to water spray opening 22 also works as the white smoke temperature regulator. However, these devices may also be provided independently.

In addition, when an arrangement is achieved in which a plurality of each of the aforementioned warm water spray opening 22 and $LN_2$ spray opening 3 are provided in a manner such that the cryogenic gas and warm water, discharged from respective spray openings 3 and 22, counter contact in all directions, the contact efficiency and white smoke generation efficiency can be further improved.

What is claimed:

1. A white smoke generating apparatus comprising:

a vessel;

a discharge opening for discharging white smoke generated in said vessel to the exterior of said vessel;

a cryogenic gas spray opening for spraying cryogenic gas;

a water spray opening for spraying heated water; and a white smoke temperature regulating means for spraying heated water between said cryogenic gas spray opening and said discharge opening, wherein said cryogenic gas spray opening and said water spray opening are provided inside said vessel, and said cryogenic gas spray opening and said water spray opening are arranged such that cryogenic gas, discharged from said cryogenic gas spray opening, and heated water, discharged from said water spray opening, cross contact, and said white smoke temperature regulating means spraying heated water on white smoke generated by said cross contact to regulate the temperature of the generated white smoke.

2. A white smoke generating apparatus according to claim 1, wherein said apparatus comprises a plurality of cryogenic gas spray openings and water spray openings.

3. A white smoke generating apparatus according to claim 1, wherein said cryogenic gas spray opening and said water spray opening are arranged at right-angles to each other.

4. A white smoke generating apparatus according to claim 1, wherein said cryogenic gas is liquid nitrogen.

5. A white smoke generating apparatus according to claim 1, wherein said white smoke temperature regulating means heats white smoke generated by said cross contact, whereby the temperature thereof is raised.

6. A white smoke generating apparatus according to claim 1, wherein said cryogenic gas spray opening and said water spray opening are arranged facing each other.

7. A white smoke generating apparatus according to claim 6, wherein said cryogenic gas spray opening and said water spray opening are arranged facing each other in a horizontal direction, parallel to the water surface.

8. A white smoke generating apparatus according to claim 6, wherein said cryogenic gas spray opening and said water spray opening are arranged facing each other in a vertical direction.

9. A white smoke generating apparatus according to claim 8, wherein said cryogenic gas spray opening and said water spray opening are arranged facing each other, with said water spray opening positioned above said cryogenic spray opening.

10. A white smoke generating apparatus according to claim 8, wherein said cryogenic gas spray opening and said water spray opening are arranged facing each other, with said water spray opening positioned below said cryogenic spray opening.

11. A white smoke generating apparatus comprising:

a water tank for storing water;

a cryogenic gas spray opening for spraying cryogenic gas above the water surface of said tank;

a discharge opening for discharging white smoke generated in said water tank to the exterior of said water tank;

a temperature adjusting means for heating and maintaining the temperature of the water inside said water tank;

a circulating water spraying means for spraying water inside said water tank from a water spray opening positioned near said cryogenic gas opening; and a white smoke temperature regulating means for spraying heated water between said cryogenic gas spray opening and said discharge opening, wherein said discharge opening is provided above the water surface of said water tank, and said cryogenic gas spray opening and said water spray opening are arranged such that cryogenic gas, discharged from said cryogenic gas spray opening, and heated water, discharged from said water spray opening, cross contact, and said white smoke temperature regulating means spraying heated water on white smoke generated by said cross contact to regulate the temperature of the generated white smoke.

12. A white smoke generating apparatus according to claim 11, wherein said white smoke temperature regulating means heats white smoke generated by said cross contact, whereby the temperature thereof is raised.

13. A white smoke generating apparatus according to claim 11 wherein said apparatus comprises a plurality of cryogenic gas spray openings and water spray openings.

14. A white smoke generating apparatus according to claim 11, wherein said cryogenic gas spray opening and said water spray opening are arranged at right-angles to each other.

15. A white smoke generating apparatus according to claim 11, wherein said cryogenic gas is liquid nitrogen.

16. A white smoke generating apparatus according to claim 11, wherein said cryogenic gas spray opening and said water spray opening are arranged facing each other.

17. A white smoke generating apparatus according to claim 16, wherein said cryogenic gas spray opening and said water spray opening are arranged facing each other in a horizontal direction, parallel to the water surface.

18. A white smoke generating apparatus according to claim 16, wherein said cryogenic gas spray opening and said water spray opening are arranged facing each other in a vertical direction.

19. A white smoke generating apparatus according to claim 18, wherein said cryogenic gas spray opening and said water spray opening are arranged facing each other, with said water spray opening positioned above said cryogenic spray opening.

20. A white smoke generating apparatus according to claim 18, wherein said cryogenic gas spray opening and said water spray opening are arranged facing each other, with said water spray opening positioned below said cryogenic spray opening.

* * * * *